United States Patent [19]

Shoop

[11] Patent Number: 4,690,073

[45] Date of Patent: Sep. 1, 1987

[54] LOCKING MECHANISM

[75] Inventor: James D. Shoop, Stark County, Ohio

[73] Assignee: Diebold, Incorporated, Canton, Ohio

[21] Appl. No.: 888,919

[22] Filed: Jul. 23, 1986

[51] Int. Cl.[4] ..... E05G 1/04; E05B 13/10

[52] U.S. Cl. ..... 109/59 T; 70/218; 70/DIG. 63

[58] Field of Search ..... 109/59 R, 59 T; 70/149, 70/188, 218, 219, 472, 484, 485, DIG. 63; 292/336.3, 359, DIG. 27

[56] References Cited

U.S. PATENT DOCUMENTS

| | | | |
|---|---|---|---|
| 317,471 | 5/1885 | Pund | 70/218 |
| 1,607,361 | 11/1926 | Poland et al. | 70/DIG. 63 |
| 4,033,157 | 7/1977 | Williams | 70/DIG. 63 |

FOREIGN PATENT DOCUMENTS

| | | | |
|---|---|---|---|
| 685943 | 12/1939 | Fed. Rep. of Germany | 70/218 |

*Primary Examiner*—Gary L. Smith
*Assistant Examiner*—Neill Wilson
*Attorney, Agent, or Firm*—D. Peter Hochberg

[57] ABSTRACT

A locking mechanism selectively engages and isolates an external handle of a vault door from both a bolt and a pair of locks which control the condition of the door. The mechanism includes a slide vertically movable between first and second positions in response to the conditions of the locks. The slide incorporates a pin at its lower end. The handle is mounted on a shaft that extends through the door and terminates on the interior side in a hub. A housing mounted for rotation on the interior side of the door incorporates an inverter "T-shaped" guide slot which accepts the pin. When the pin is in the vertical leg of the "T-shaped" slot, rotation of the housing is inhibited. A probe is mounted for movement on the housing and is biased toward the hub. The probe is attached to a yoke which engages the pin such that when the pin is in the first position the probe is retracted from the hub. When the pin is in the second position the probe engages the hub, which causes the hub and housing to move together in response to rotation of the handle. The housing is connected to the bolt of the vault door which moves between the latched and unlatched conditions in response to movement of the housing.

16 Claims, 5 Drawing Figures

LOCKING MECHANISM

TECHNICAL FIELD

The present invention relates to mechanisms used to open doors such as vault doors. In particular the invention relates to mechanisms which operate when a door is in the secured condition to disconnect and isolate an external handle from a bolt which latches the door and locks which control the condition of the door.

BACKGROUND ART

In some types of vault doors, the handle which is used to move the bolt between the latched and unlatched conditions is connected at all times to the bolt means and the locking means. When such doors are in the secured condition, the handle is not movable until after a correct combination is dialed into a lock. A problem with this arrangement is that the mechanical connection between the handle and the lock enables an experienced safe cracker to use the handle to "feel" the lock and decipher its combination.

A number of security devices have been developed which can be used to selectively disengage a handle depending on the condition of a lock. U.S. Pat. Nos. 1,645,917; 1,560,509; 1,560,508; 1,560,504; and 1,560,503 all disclose handles which selectively engage and disengage depending on the condition of a lock. Such devices are not suitable for use with secure doors such as vault doors because the locks are integral with the externally mounted handles. This arrangement causes the entire locking mechanism to be exposed to tampering.

Mechanisms for selectively engaging the handle of a safe door mounted internal to the door are disclosed in U.S. Pat. Nos. 102,780 and 269,953. Such mechanisms suffer the disadvantage that there is mechanical contact at all times between the locking means and the handles which enables a safe cracker to "feel" the locking means. In addition, these mechanisms suffer from the disadvantage that removal of the handle shafts by an attacker will allow the mechanisms to be readily defeated.

Thus, there exists a need for a mechanism that selectively engages and disengages an external handle and the bolt of a vault door in response to the condition of locking means and which mechanically isolates the bolt and locking means from the handle when the door is in the secured condition. Further, there exists a need for a mechanism which cannot be defeated by attack on the shaft to which the external handle is mounted.

DISCLOSURE OF INVENTION

It is an object of the present invention to provide a mechanism for securing a door which selectively engages and disengages a handle to a bolt of the door depending on the condition of locking means.

It is a further object of the invention to provide a mechanism for securing a door which isolates the handle from the bolt and the locking means at all times except when the locking means is in the unsecured condition.

It is a further object of the invention to provide a mechanism for securing a door which has enhanced resistance to burglar attack.

It is a further object of the invention to provide a mechanism for securing a door which can be used without modification for either left or right hand doors.

It is a further object of the invention to provide a mechanism for securing a door which can be used with various types of locking arrangements.

Further objects of the present invention will be made apparent in the attached description of the best modes for carrying out the invention and the appended claims.

The foregoing objects are accomplished by a mechanism selectively engaging an external handle of a vault door to a bolt which holds the door latched in the secured condition and a pair of locks which control the condition of said door. The mechanism comprises a slide mounted for movement on the interior surface of the door. The slide is connected to the locks by a linkage and is movable between first and second positions depending on the condition of said locks. The slide incorporates a pin at its lower end. The handle is mounted on a shaft which extends through said door. A hub is fixably mounted on the shaft on the interior side of the door. A housing which incorporates a sleeve is mounted for rotation on the inside surface of the door, which sleeve is concentric with the shaft. The hub is free to rotate in the sleeve when the door is in the secured condition. The sleeve incorporates a hole for access to the hub. A "T" shaped guide slot in the housing accepts the pin on the slide. A first leg of said guide slot enables movement of the pin between first and second positions corresponding with the first and second positions of the slide. A second leg of said "T" shaped guide slot is arcuate and enables the housing to rotate to the extent of the angle of the slot when the pin and slide are in the second position. When the pin is in the first leg of the slot, rotation of the housing is inhibited. A probe is mounted for movement on said housing and is biased toward said sleeve. The probe is connected to a yoke which engages the pin so that when the pin is in the first position, the probe is retracted from the sleeve. When the pin is in the second position, the probe extends through the hole in the sleeve and engages the hub. In this condition the probe rigidly connects the hub and housing causing them to move together in response to rotation of the handle. When the probe is in engagement with the hub, the pin on the slide is in its second position which enables rotation of the housing to the extent of the arc of the second leg of the "T" shaped guide slot. The housing includes a pivot eye which accepts a bolt connecting link. The link is connected to the bolt of the door so that rotation of the housing moves the bolt between the latched and unlatched conditions.

BEST MODES FOR CARRYING OUT INVENTION

Figure 1:
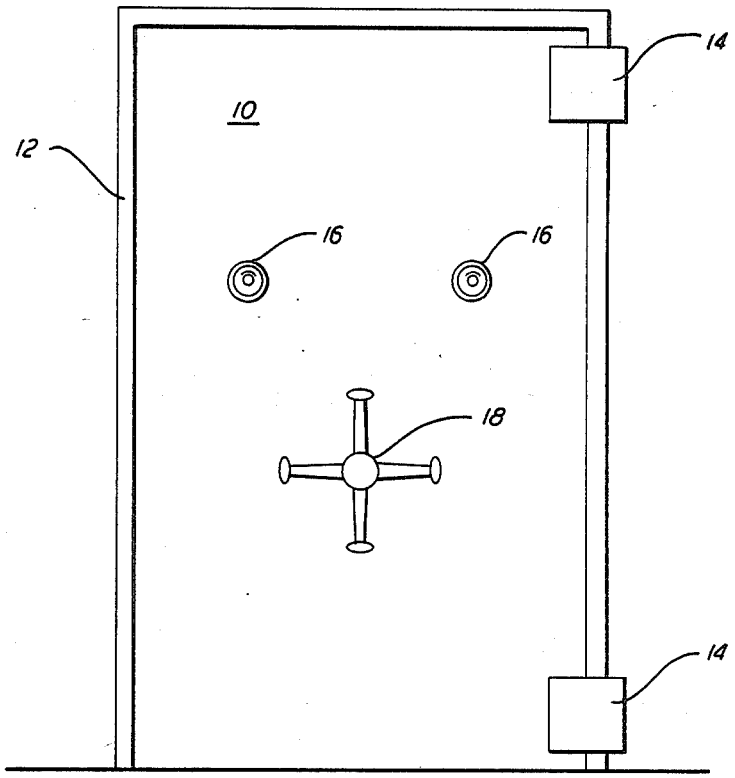
FIG. 1 is a front view of the exterior of a vault door which incorporates the preferred embodiment of the present invention.

Referring now to the drawings and particularly to FIG. 1, there is shown therein a vault door generally referred to as 10 which incorporates the preferred embodiment of the present invention. The door is mounted in a jamb 12 on hinges 14. Door 10 is preferably made of the high strength concrete material disclosed in U.S. Pat. No. 4,559,881, owned by the assignee of the present invention. Extending from the front of door 10 are a pair of combination lock dials 16 and a handle 18. The vault door of the preferred embodiment incorporates a pair of combination locks for purposes of enhanced security. Each lock has a different combination and the correct combination of each lock must be input to place the door in the unsecured condition. Generally individuals are given the combination of only one lock and in this way the cooperation of two individuals is required to open the vault door. It is not necessary to use two locks for purposes of the present invention however, as later explained.

Figure 2:
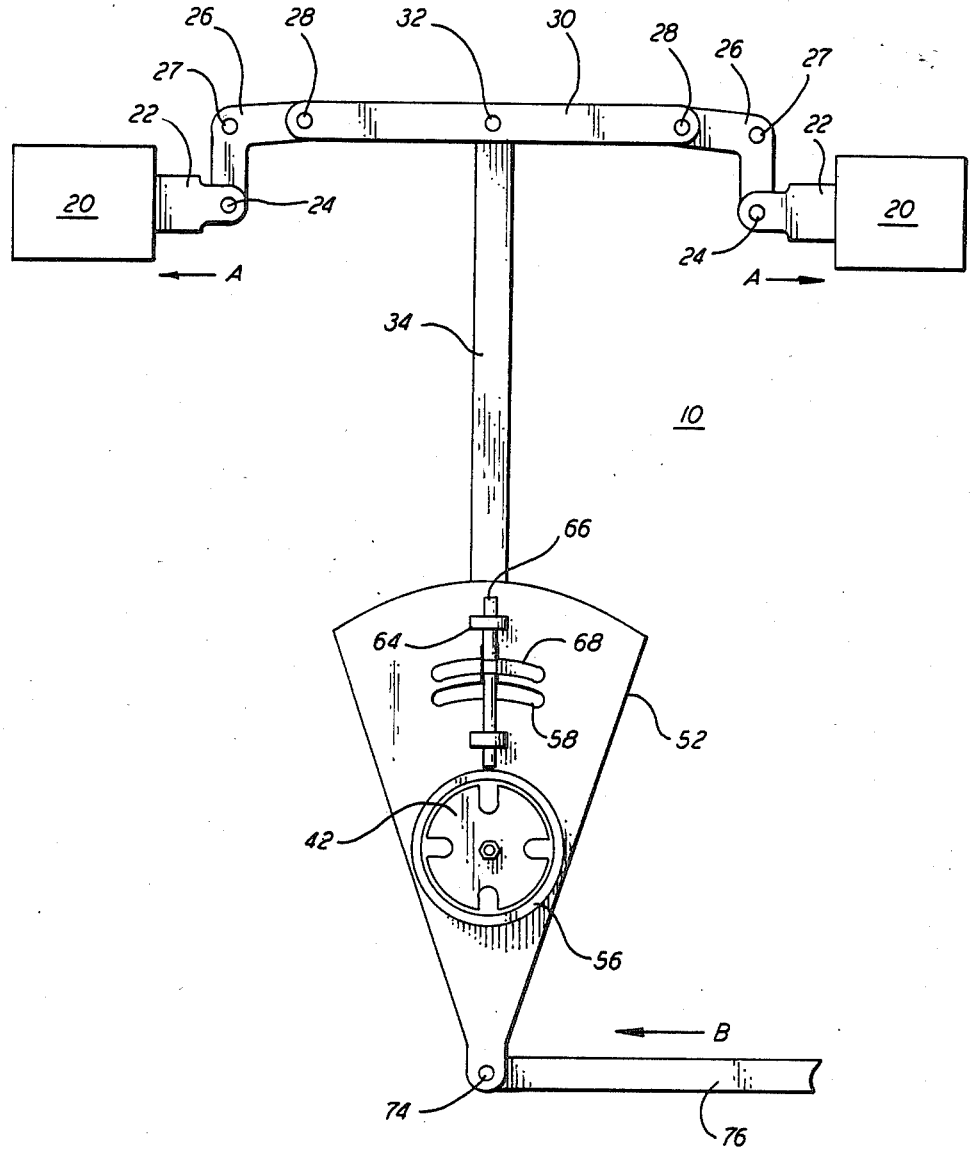
FIG. 2 is a view of the interior surface of the vault door incorporating the preferred embodiment of the present invention.

Dials 16 are mounted on shafts (not shown) which extend through door 10 and into the case of locks 20 (see FIG. 2) which are secured on the interior surface of door 10 by attaching means (not shown). Bolts 22 extend from each of the locks 20. Pins 24 connect bolts 22 and intermediate links 26. Intermediate links 26 are "dog-legged" and pivot about pivot pins 27 which extend from the interior face of door 10. Intermediate links 26 terminate in pins 28. Pins 28 connect intermediate links 26 to a cros link 30.

Figure 5:
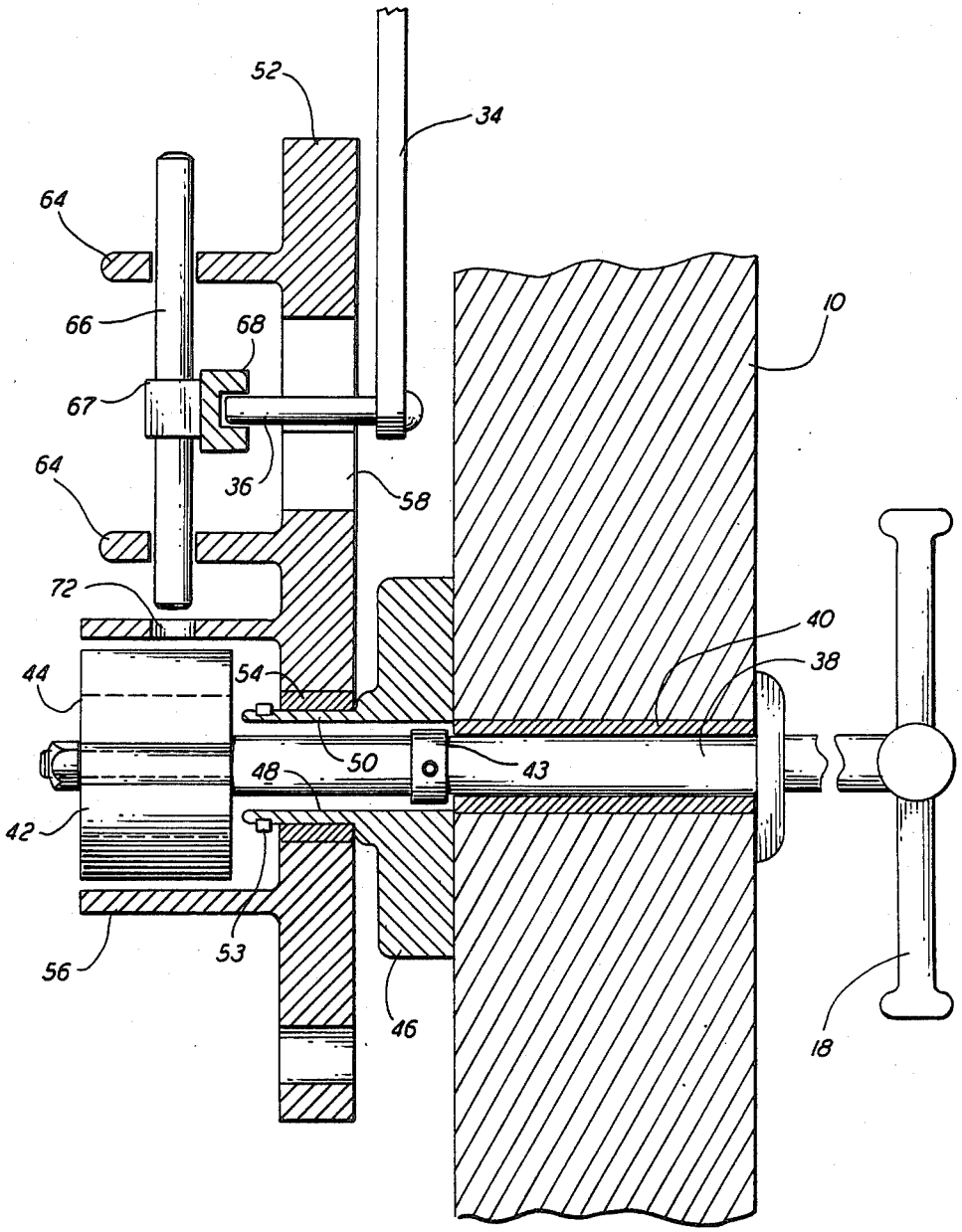
FIG. 5 is a partially sectioned view of the vault door incorporating the preferred embodiment of the present invention.

Cross link 30 includes a pin 32 at its mid point. Pin 32 connects cross link 30 to a slide 34. Slide 34 is constrained to move vertically in guide means (not shown) on the interior surface of door 10. Locks 20 are arranged so that bolts 22 retract in the directions of arrows A when the correct combination of each lock is input at its corresponding dial 16. As bolts 22 retract, the action of the linkage means comprised of intermediate links 26 and cross link 30 cause slide 34 to move downward in response to the correct combinations being dialed into each of the locks. Slide 34 incorporates pin means 36 at its lower end (see FIG. 5).

Handle 18 is connected to a shaft 38 which extends through door 10. Shaft 38 rides in bearing means 40. Shaft 38 terminates in a hub 42 which serves as a moving member means. Hub 42 is fixably attached to shaft 38 by locking means (not shown). Hub 42 includes a plurality of radial grooves 44, the purpose of which is later discussed. Shaft 38 includes locking collar means 43 which prevents lateral movement thereof.

A bearing plate 46 is mounted on the inside of door 10 by mounting means (not shown). Bearing plate 46 includes a bore 48, the center line of which is concentric with the center line of shaft 38. Bearing plate 46 also includes a race 50.

A pie-shaped housing 52 is mounted for rotation on race 50. Bearing means 54 provide for ease of rotation of housing 52. A locking ring 53 prevents lateral movement of housing 52 and assures that it maintains its mounting on race 50.

Figure 3:
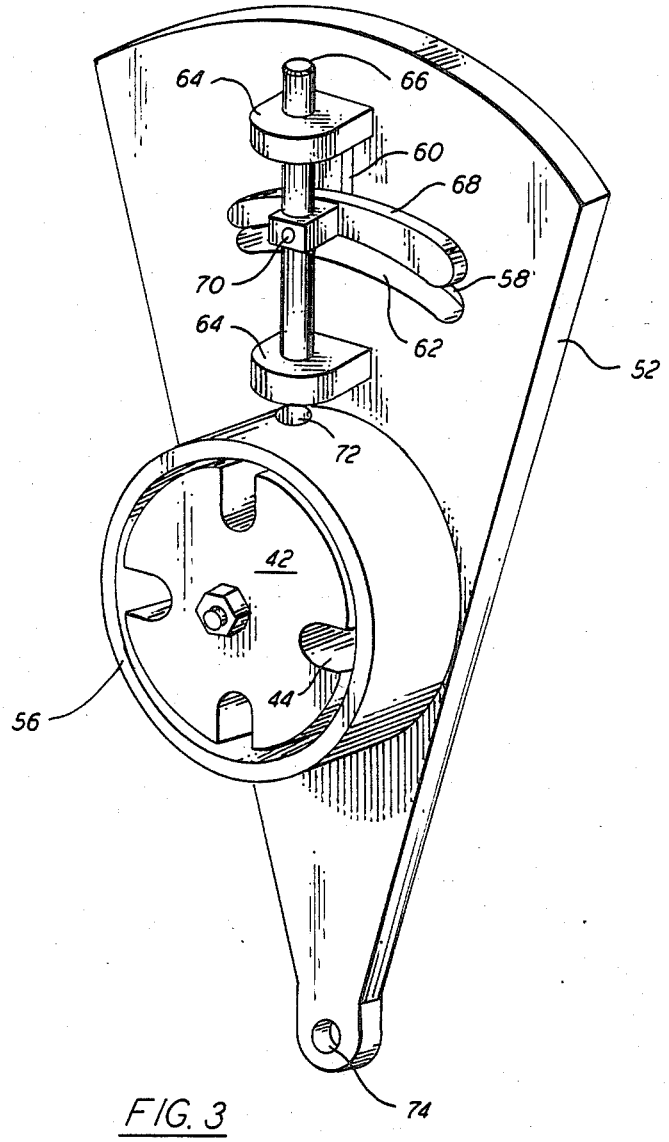
FIG. 3 is a perspective view of the housing and hub portions of the preferred embodiment of the present invention in the secured condition.

Housing 52 includes integral sleeve means 56 (see FIG. 3). Hub 42 is free to rotate in sleeve 56 when door 10 is in the secured condition. Housing 52 incorporates a "T" shaped guide slot 58. Slot 58 has a first leg 60 which serves as first slot means and an intersecting second leg 62 which serves as second slot means. Second leg 62 is cut in an arc about the center line of shaft 38. Legs 60 and 62 serve to guide and are sized to accept with slight clearance pin 36.

Housing 52 incorporates a pair of ears 64 which extend from the face thereof. Ears 64 are in line with first leg 60 of "T" shaped slot 68. A probe 66 is 3ournaled in ears 64 such that radial movement toward sleeve 56 is enabled but rotation is prevented. A "banana" shaped yoke 68 is mounted on probe means 66 and moves therewith. Yoke 68 is sized to accept pin 36 which extends beyond the face of housing 52. Yoke 68 includes a square portion 67 in which probe 66 is journaled. Locking means 70 secure yoke 68 and probe 66 in proper relation and provides for ease of adjustment. Yoke 68 is arcuate and corresponds to second leg 62 of "T" shaped slot 58.

Sleeve 56 incorporates an access hole 72 positioned under and sized to accept probe 66. Housing 52 terminates in a pivot eye 74. Pivot eye 74 is connected to a link 76 (see FIG. 2). Link 76 serves as bolt connecting means and moves along the line of action of arrow B in response to rotational movement of handle 18 when the door is in the unsecured condition. Link 76 is connected to a door bolt (not shown). The door bolt can be any one of the conventional types. For purposes of this description, it is assumed the bolt is the type that is movable between a latched position in which it extends beyond the door into a strike in the jamb and an unlatched position in which it is retracted from the strike. In the position shown in FIG. 2 the bolt of the door is in the extended and latched position. Movement of link 76 in the direction of arrow B moves the bolt to the retracted and unlatched position.

In operation when door 10 is in the secured condition, handle 18 is freewheeling. This occurs because pin 36 is in the upper portion of first leg 60 of "T" shaped slot 58 which in turn causes yoke 68 to hold probe 66 out of hole 72 in sleeve 56. In the secured condition the presence of pin 36 in first leg 60 also prevents rotation of housing 52. This insures that link 76 and the bolt of the door remain in the latched position.

When the correct combinations are dialed into locks 20, bolts 22 retract. This causes intermediate links 26 to rotate and move cross link 30 and slide 34 downward. Pin 36 moves downward correspondingly from a first position in first leg 60 of "T" shaped slot 58. When both locks 20 are in the open condition, pin 36 moves sufficiently downward so as to be located in a second position fully downward and at the intersection of first leg 60 and second leg 62 of the "T" shaped slot.

In the preferred embodiment bolts 22, intermediate links 26, cross link 30, and slide 34 are arranged so both of locks 20 must be in the open condition to move pin 36 sufficiently downward into second leg 62 before housing 52 can rotate. Persons having skill in the art will understand that other arrangements of linkage means can be employed in conjunction with the invention so that a single lock or a plurality of locks may be used to control the position of the slide. For example, a single lock may be used to control the present device by eliminating one of locks 20 and fixing the point of rotation of the pin 28 opposite the remaining lock.

Figure 4:
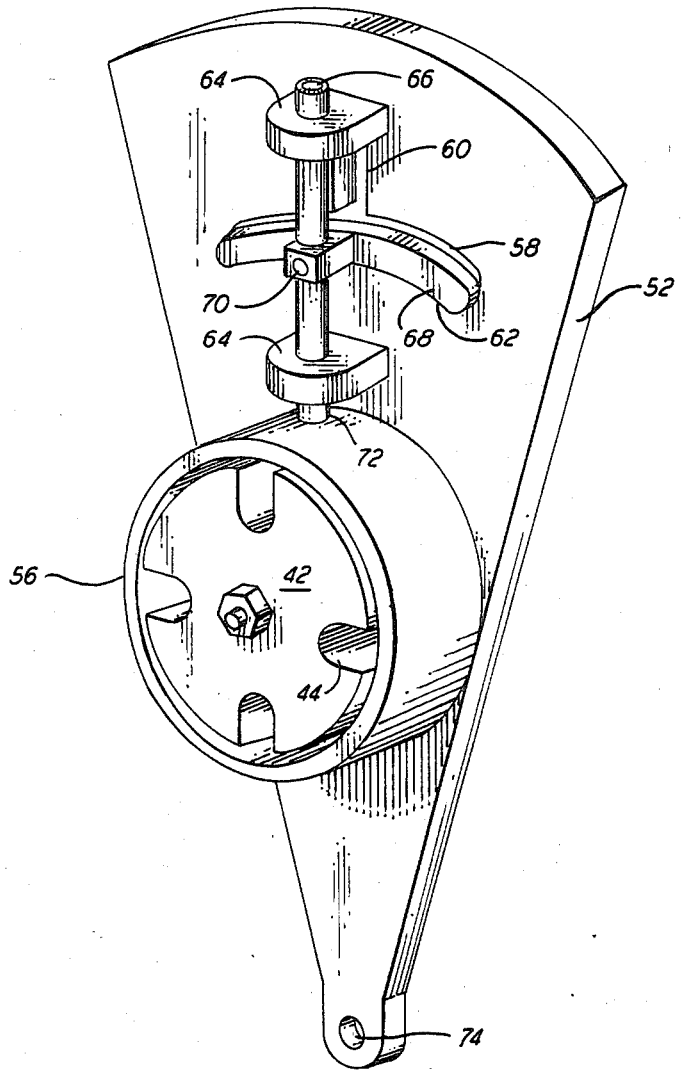
FIG. 4 is a perspective view of the housing and hub portions of the preferred embodiment of the present invention in the unsecured condition.

When both of locks 20 are unlocked and pin 36 is positioned in second leg 62 of "T" shaped slot 58, housing 52 becomes free to rotate to the extent of the angle of arcuate second leg 62. The movement of pin 36 downward also enables yoke 68 to move downward resulting in movement of probe 66 from a first condition shown in FIG. 3 to the a second condition shown in FIG. 4. As the arc of yoke 68 corresponds to the arc of second leg 62, the yoke does not inhibit rotation of housing 52. For the condition shown in FIG. 4, probe 66 extends through access hole 72 in sleeve 56. Probe 66 is moved downward in the preferred embodiment by the force of pin 36 on yoke 68 and engages hub 42 by catching in one of radial grooves 44 which serve as probe engaging means. In this condition housing 52 is in connection with hub 42 and is rotable in response to movement of handle 18 to the extent of the angle of arcuate second leg 62. In response to counterclockwise rotation of handle 18, pivot eye 74 moves link 76 in the direction of arrow B which retracts the bolt means of the door and places it in the unlatched condition so it can be opened.

When it is desired to lock the door, it is first moved to the closed position in jamb 12 and handle 18 is moved in the clockwise direction to extend and latch the bolt. This action moves housing 52 so that pin 36 is in its second position but in alignment with first leg 60 of slot 58. In response to locking one (or both) of locks 20, bolts 22 retracts moving pin 36 upward into its first position in first leg 60. In this position pin 36 prevents rotation of housing 52. As pin 36 moves upward, it pulls yoke 68 and probe 66 upward as well. This results in probe 66 moving from its second condition to its first condition, disengaging hub 42, and thus handle 18 becomes freewheeling.

It should be noted that housing 52 is symmetrical and second leg 62 of "T" shaped slot 58 extends in both directions from first leg 60 as does yoke 68 even though pin 36 will only occupy one side of second leg 62 and yoke 68 as the bolt of door 10 is moved between the latched and unlatched conditions. The symmetrical nature of slot 58 and yoke 68 allows the preferred embodiment of the invention to be used with doors that are hinged opposite of door 10 (so called "left-hand doors"). The mechanism may be used for an opposite hand door by moving link 76 to the other side of pivot eye 74 where it can be used to extend and retract a bolt which is located on the opposite side. This construction is a substantial innovation in that prior vault door actuating mechanisms are different depending on whether they are intended for left-hand or right-hand mounting.

Although in the preferred embodiment the housing 52 is rotable and slot 58 is "T-shaped" and located above the axis of rotation of the housing, other embodiments of the invention may use slots having other configurations and housings that translate in another manner. A relationship found in many embodiments however, is that the pin occupies a portion of the second leg which extends in a first direction from a point where said first and second legs intersect, as said housing moves in a second direction opposite said first direction, to move said bolt.

In the preferred embodiment of the present invention, there is no mechanical contact between locks 20 and handle 18. In the secured condition, slide 34 and pin 36 are not in contact with door 10 or housing 52. In addition, for the secured condition of door 10, handle 18 is not in contact with housing 52. The isolation of these components prevents a safe cracker from determining the combination of locks 20 by sensing vibration or other characteristics of handle 18. An additional advantage of the preferred embodiment of the present invention is that handle 18 and shaft 38 if removed by attack measures will not provide access to the housing which controls latching of the door bolt means. In this way the invention achieves greater burglar resistance.

Thus, the new vault door handle mechanism achieves the above-stated objectives, eliminates difficulties encountered in the use of prior devices, solves problems, and attains the desirable results described herein.

In the foregoing description, certain terms have been used for brevity, clarity, and understanding, however no unnecessary limitations are to be implied therefrom because such terms are used for descriptive purposes and are intended to be broadly construed. Moreover, the description and illustrations given are by way of examples and the invention is not limited to the exact details shown or described.

Having described the features, discoveries, and principles of the invention, the manner in which it is utilized, and the advantages and useful results obtained, the new and useful structures, devices, elements, arrangements, parts, combinations, systems, equipment, operations, methods, and relationships are set forth in the appended claims.

I claim:

1. Apparatus for selectively engaging an external handle associated with a door to a movable bolt for securing said door in a jamb, according to a condition of locking means associated with said door, said locking means settable between locked and unlocked conditions and controlling movement of a pin, said pin having a first position corresponding to said locked condition and a second position corresponding to said unlocked condition, said apparatus comprising:

means for holding said pin on a path between said first position and said second position;

a housing;

first slot means in said housing extending in a first direction for accepting said pin, said first slot means enabling movement of said pin between said first and second positions;

second slot means in said housing for accepting said pin, said second slot means intersecting with said first slot means at an intersection and extending therefrom in a second direction;

mounting means mounting said housing for movement of said door, said mounting means enabling movement of said housing opposite said second direction and transverse to said first direction when the pin is in the second slot means;

a probe mounted for movement on said housing, said probe being movable between a first condition and a second condition;

probe connecting means for connecting the probe and the pin such that movement of said pin between said first and second positions moves said probe between said first and second conditions respectively;

a moving member, said member including probe engaging means for engaging said probe, said housing and said member movable together for said second condition of said probe;

handle connecting means for connecting said moving member and said handle; and bolt connecting means for connecting said housing and said bolt, whereby said bolt is moved in response to movement of said housing.

2. The apparatus according to claim 1 and further comprising a sleeve adjacent said moving member and operatively connected to said housing, said sleeve including access means for said probe.

3. The apparatus according to claim 2 wherein said handle connecting means is a shaft extending through said door.

4. The apparatus according to claim 3 wherein said shaft is rotable about a fixed axis, said sleeve is concentric about said fixed axis and said second direction is a rotational direction about said fixed axis.

5. The apparatus according to claim 4 wherein said moving member is a circular hub, said probe engaging means is a plurality of slots in said hub and said access means is a hole through said sleeve.

6. The apparatus according to claim 1 wherein said first and second slot means are first and second guide slots through said housing, said slots being perpendicular at said intersection.

7. The apparatus according to claim 6 wherein said pin extends through said slots and said probe connecting means includes a yoke accepting said pin.

8. The apparatus according to claim 7 wherein said yoke corresponds to said second guide slot and is movable with said housing when the pin is in the second condition.

9. The apparatus according to claim 5 wherein said first and second slot means are first and second guide slots through said housing, said guide slots being perpendicular at said intersection.

10. The apparatus according to claim 9 wherein said pin extends through said slots and said probe connecting means includes a yoke accepting said pin.

11. The apparatus according to claim 10 wherein said yoke corresponds to said second guide slot and is movable in said rotational direction with said housing when the pin is in the second position.

12. The apparatus according to claim 1 wherein said second slot means extends in a direction opposite said second direction from said intersection, whereby said housing is movable in said second direction.

13. The apparatus according to claim 9 wherein said second guide slot extends in the rotational direction from said intersection, whereby said housing is rotable opposite said rotational direction.

14. The apparatus according to claim 11 wherein said bolt connecting means includes an eye mounted on said housing and a connecting link connecting said eye and said bolt.

15. The apparatus according to claim 1 wherein said locking means includes a slide mounted for movement on said door, said slide incorporating said pin and having first and second slide positions corresponding respectively to said first and second positions of said pin, and a pair of combination locks, each of said locks including a lock bolt, said bolts having a first lock bolt position for said locked condition and a second lock bolt position for said unlocked condition, said lock bolts connected by linkage means to said slide, whereby said slide is in the second slide position when said both of said locks are in the unlocked condition.

16. The apparatus according to claim 15 wherein said linkage means includes an intermediate rotatable link associated with each of said locks and a cross link connecting said intermediate links and said slide.

* * * * *